US009863068B2

(12) United States Patent
Przytarski et al.

(10) Patent No.: US 9,863,068 B2
(45) Date of Patent: Jan. 9, 2018

(54) BLADE FOR MOVING HOOKS OF A JACQUARD MECHANISM AND JACQUARD MECHANISM COMPRISING SUCH A BLADE

(71) Applicant: STAUBLI LYON, Chassieu (FR)

(72) Inventors: Patrice Przytarski, Chaponnay (FR); Sylvain Durand-Peyre, Fontaines sur Saone (FR)

(73) Assignee: STAUBLI LYON, Chassieu (FR)

( * ) Notice: Subject to any disclaimer, the term of this patent is extended or adjusted under 35 U.S.C. 154(b) by 0 days.

(21) Appl. No.: 15/184,010

(22) Filed: Jun. 16, 2016

(65) Prior Publication Data

US 2016/0369430 A1 Dec. 22, 2016

(30) Foreign Application Priority Data

Jun. 22, 2015 (FR) ..... 15 55696

(51) Int. Cl.

| | |
|---|---|
| ***D03C 3/12*** | (2006.01) |
| ***D03C 3/24*** | (2006.01) |
| ***D03C 3/40*** | (2006.01) |
| ***D03C 3/20*** | (2006.01) |
| *D03C 3/00* | (2006.01) |

(52) U.S. Cl.

CPC ..... *D03C 3/24* (2013.01); *D03C 3/20* (2013.01); *D03C 3/40* (2013.01); *D03C 3/12* (2013.01)

(58) Field of Classification Search

CPC . D03C 3/24; D03C 3/20; D03C 13/00; D03C 3/06; D03C 3/12; D03C 3/205; D03C 3/32; D03C 3/40

See application file for complete search history.

(56) References Cited

U.S. PATENT DOCUMENTS

| | | | | |
|---|---|---|---|---|
| 5,743,308 | A * | 4/1998 | Bassi | D03C 3/06 139/455 |
| 7,007,721 | B2 * | 3/2006 | Bassi | D03C 3/20 139/59 |
| 7,017,618 | B2 * | 3/2006 | Bassi | D03C 3/06 139/59 |
| 7,490,633 | B2 * | 2/2009 | Bouchet | D03C 3/24 139/317 |
| 2005/0103394 | A1 * | 5/2005 | Bassi | D03C 3/20 139/59 |
| 2007/0267083 | A1 * | 11/2007 | Bouchet | D03C 3/24 139/55.1 |
| 2016/0369430 | A1 * | 12/2016 | Przytarski | D03C 3/24 |

FOREIGN PATENT DOCUMENTS

| | | |
|---|---|---|
| DE | 20114552 | 10/2001 |
| EP | 1619279 | 1/2006 |

OTHER PUBLICATIONS

French Search Report in related FR App. No. 1555696, dated Apr. 5, 2016.

* cited by examiner

*Primary Examiner* — Bobby Muromoto, Jr.
(74) *Attorney, Agent, or Firm* — Dowell & Dowell, PC

(57) ABSTRACT

A blade for moving hooks of a Jacquard mechanism for forming a shed on a Jacquard loom wherein the blade includes at least one profile made from a composite material, having a body made of unidirectional fibers that extend in a longitudinal direction (X12) of the at least one profile and are embedded in a resin.

15 Claims, 6 Drawing Sheets

BLADE FOR MOVING HOOKS OF A JACQUARD MECHANISM AND JACQUARD MECHANISM COMPRISING SUCH A BLADE

BACKGROUND OF THE INVENTION

Field of the Invention

The present invention relates to a blade for moving hooks of a Jacquard mechanism and a Jacquard mechanism comprising such a blade.

Brief Description of the Related Art

In a known manner, a Jacquard mechanism, or Jacquard machine, is a device for forming a shed on a Jacquard loom and comprises a series of blades, or knives, that are driven in an alternating vertical movement in phase opposition, i.e., when one blade is in a high position, the two blades adjacent to it are in a low position. A multitude of hooks arranged in rows are able to cooperate with each blade. The hooks of two adjacent blades are connected in pairs by a rope. The movement of the hooks is commanded by that of the blades and by a system for selective immobilization of the hooks, such as an electromagnet system. A pulley system makes it possible to transmit the movement from each pair of hooks to a heddle crossed through by a warp yarn. This then makes it possible to create the shed for the passage of a weft yarn. The blades of a Jacquard mechanism can reach a length of four meters for large-format Jacquard mechanisms. The stiffness in bend of the blades is essential to guarantee uniform driving of the hooks over the entire length of the blade. Thus, the blades of a Jacquard mechanism are typically made in the form of an extruded aluminum profile, which is cut to the desired length and is connected at both of its longitudinal ends to a mechanism transmitting the rotational movement of an input shaft, this mechanism comprising rotating shafts, connecting rods, levers, gripping frames and/or cams. Furthermore, the height of the aluminum profile is chosen based on the fabric to be produced and the format of the Jacquard mechanism.

SUMMARY OF THE INVENTION

The invention seeks to reduce the mass of the blades of the Jacquard mechanism, while guaranteeing their stiffness in bend, and to define a blade profile shared by all Jacquard mechanism formats, i.e., all fabric formats.

To that end, the invention relates to a blade for moving hooks that belong to a Jacquard mechanism, each moving hook being able to be immobilized by a selection device to determine the position of a warp yarn on a loom. According to the invention, this blade comprises at least one profile made from a composite material, having a body made up of unidirectional fibers that extend in the longitudinal direction of the profile and are embedded in a resin.

Owing to the use of a profile made from a composite material, the blades of the Jacquard mechanism are lighter than aluminum blades and have a stiffness in bend equivalent to or greater than that of the latter. Indeed, the unidirectional reinforcing fibers impart good stiffness and the mass of the blade can be reduced by a quarter, or even half depending on the formats, relative to an aluminum blade, which is advantageous to increase the operating speeds of the Jacquard machine. Furthermore, the invention makes it possible to use an identical blade height, irrespective of the format of the Jacquard mechanism on which they are mounted, i.e., the blades have a profile shared by all Jacquard mechanism formats and only the length of the blades must be adapted based on the machine used.

Thus, if the blades are made by molding, a mold configured to manufacture a blade with a maximal length may be used to manufacture blades of a Jacquard mechanism with any format. The length of the blades is next adjusted by cutting if necessary. A mold may also be used for each Jacquard machine format. In this case, the blade leaves the mold directly with the correct length. Likewise, if the blades are obtained by pultrusion, a same draw plate may be used to manufacture all of the blades, irrespective of the format of the Jacquard mechanism in question.

According to advantageous, but optional aspects of the invention, such a blade may comprise one or more of the following features, considered in any technically allowable combination:

- The body of the profile comprises an upper part, an intermediate part and a lower part, the intermediate part having a central core with a thickness smaller than that of the lower part and/or smaller than that of the upper part.
- The profile comprises a fiber-based film that at least partially covers a thickness variation portion of the body.
- The unidirectional fibers of the body of the profile are carbon fibers, and the resin is an ellpoxide resin.
- The cross-section of the profile is constant over the entire length of the profile.
- The blade further comprises two fastening blocks to a mechanism for transmitting the movement of the Jacquard mechanism, the two blocks being fastened to the two longitudinal ends of the profile.
- Each fastening block includes at least one side wall across from a side face of the profile for the fastening of each block with the profile.
- The two blocks are fastened to the profile at least by gluing.
- Each fastening block comprises a body with a U-shaped section, including a bottom wall and two side walls, the two side walls each including an inner surface, the bottom wall being across from the longitudinal end surface of the profile, and a glue joint extending between each inner surface and a side face of the profile, at the intermediate part of the body.
- Each fastening block comprises upper and lower end parts that are longitudinally offset relative to each side wall and that comprise means for fastening to the mechanism.
- The blade further comprises at least one longitudinal interface rail that partially covers the outer surface of the profile and that is able to cooperate with the moving hooks of the Jacquard mechanism.
- The blade comprises several metal interface rails distributed over the length of the profile and spaced apart from one another.
- Each interface rail has a U-shaped section and is glued around the profile.

The invention also relates to a Jacquard mechanism comprising a blade as previously defined.

According to one advantageous but optional aspect, the Jacquard mechanism defines several receiving volumes for Jacquard modules comprising the moving hooks, while the spacing between two rails on the blade is arranged longitudinally between two adjacent receiving volumes.

BRIEF DESCRIPTION OF THE DRAWINGS

The invention and other advantages thereof will appear more clearly, in light of the following description of one embodiment of a Jacquard mechanism blade according to its principle, provided solely as an example and done in reference to the appended drawings, in which.

DESCRIPTION OF THE PREFERRED EMBODIMENTS

Figure 1:
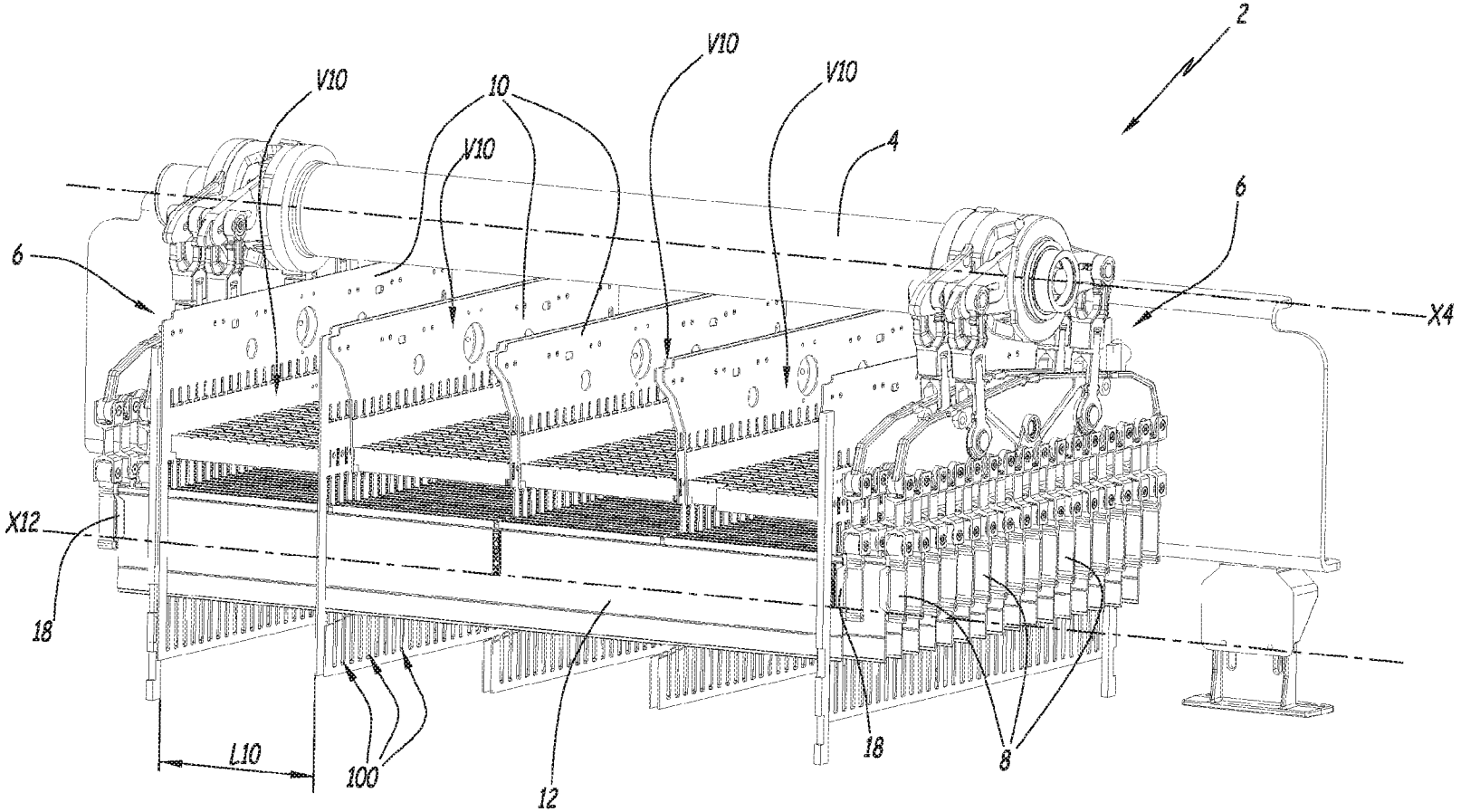
FIG. 1 is a perspective view of a Jacquard mechanism comprising blades according to the invention each making it possible to drive hooks of the Jacquard mechanism.

FIG. 1 shows a Jacquard mechanism 2, sometimes called Jacquard machine, making it possible to form the shed applied to the warp yarns of a fabric being woven on a loom. The Jacquard mechanism 2 comprises a main input shaft (not shown) and a mechanism 6 for transmitting the movement between the input shaft and a series of blades, or knives 12. This mechanism 6 comprises two coaxial shafts 4, among which only the hollow outer shaft is visible in FIG. 1. The shafts 4 are each driven in an alternating rotating movement around a longitudinal axis X4, which is horizontal during operation. The mechanism 6 also comprises levers, oblique bars and connecting rods 8 actuated by the rotation of the shafts 4. The mechanism 6 forms a kinematic chain making it possible, from the rotation of the input shaft, to move the blades 12 with a vertical alternating movement in phase opposition. Thus, during operation, when a blade 12 is in the high position, the two blades adjacent to it are in the low position. The blades 12 are positioned head-to-tail next to one another.

A multitude of moving hooks 28 is mounted in pairs on each blade 12. One pair of these hooks 28 is shown only in FIG. 4. The adjacent hooks 28 of two successive blades 12 are connected in pairs by a rope, not shown. The movement of the hooks 28 is commanded by that of the blades 12 and by a system for selective immobilization of the hooks 28, not shown, such as an electromagnet system. Each moving hook 28 is able to be immobilized by a selection device to determine the position of a warp yarn on the loom. A pulley system, not shown, makes it possible to transmit the movement from each set of hooks 28 to a heddle, not shown, crossed through by a warp yarn. This then makes it possible to create the shed for the passage of a weft yarn. The two adjacent hooks, the rope connecting them, the electromagnet system and the pulley system are part of a Jacquard module of the type described in EP 1413657.

Flanges 10 are fastened at regular intervals on the frame of the Jacquard machine. The flanges 10 are positioned transversely to a longitudinal axis X12 along which each blade 12 extends. The axis X12 is parallel to the axis X4. Two successive flanges 10 make it possible to support Jacquard modules comprising the hooks 28 and delimiting a volume V10 between them for receiving Jacquard modules. Reference L10 denotes the length of a volume V10 along the axis X12. The distance L10 substantially corresponds to the longitudinal distance between two successive flanges 10 defining the same space V10 for receiving modules. Some flanges 10 have been partially shown in FIG. 1 for better visibility of the blades 12 in the Jacquard mechanism 2. The flanges 10 are crossed through by the blades 12. To that end, the flanges 10 each define a series of vertical passage openings 100 for the blades 12. The blades 12 are connected to the transmission mechanism 6 via connecting rods 8 positioned at each of their longitudinal ends.

Figure 2:
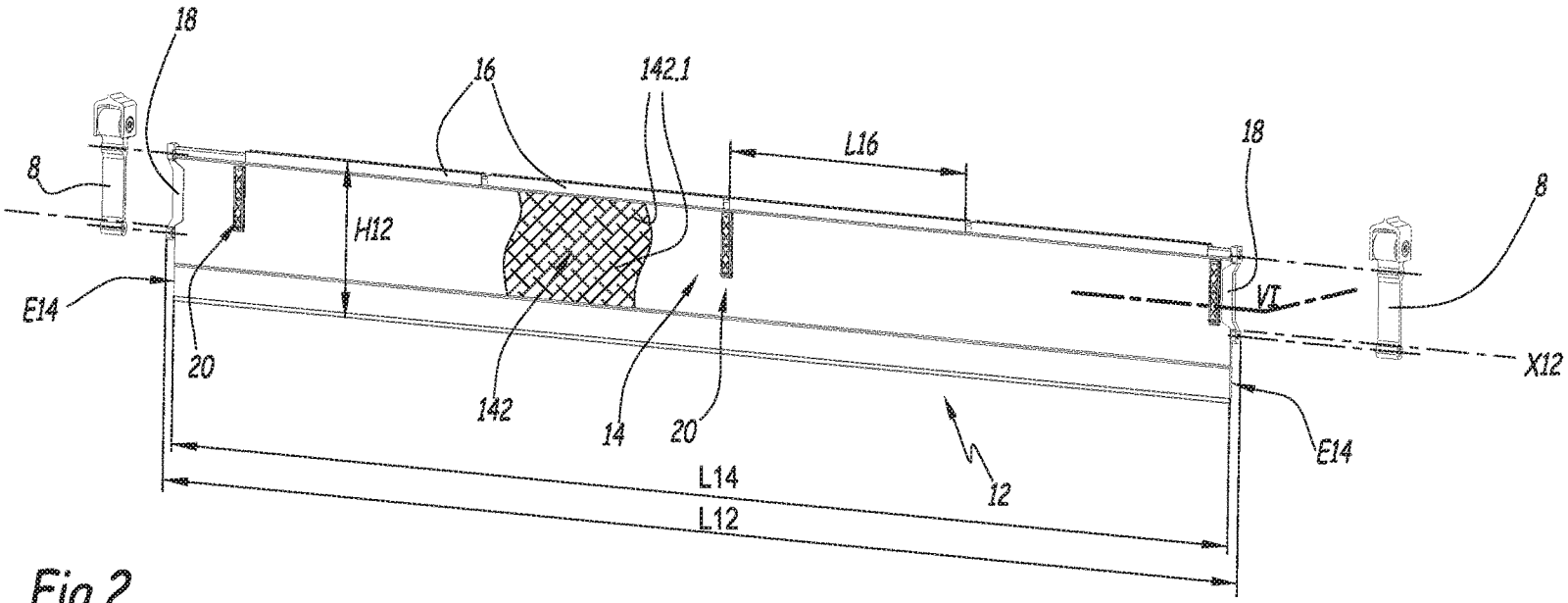
FIG. 2 is an exploded view of a blade of the Jacquard mechanism of FIG. 1 and the transmission mechanism (partially shown)
Figure 3:
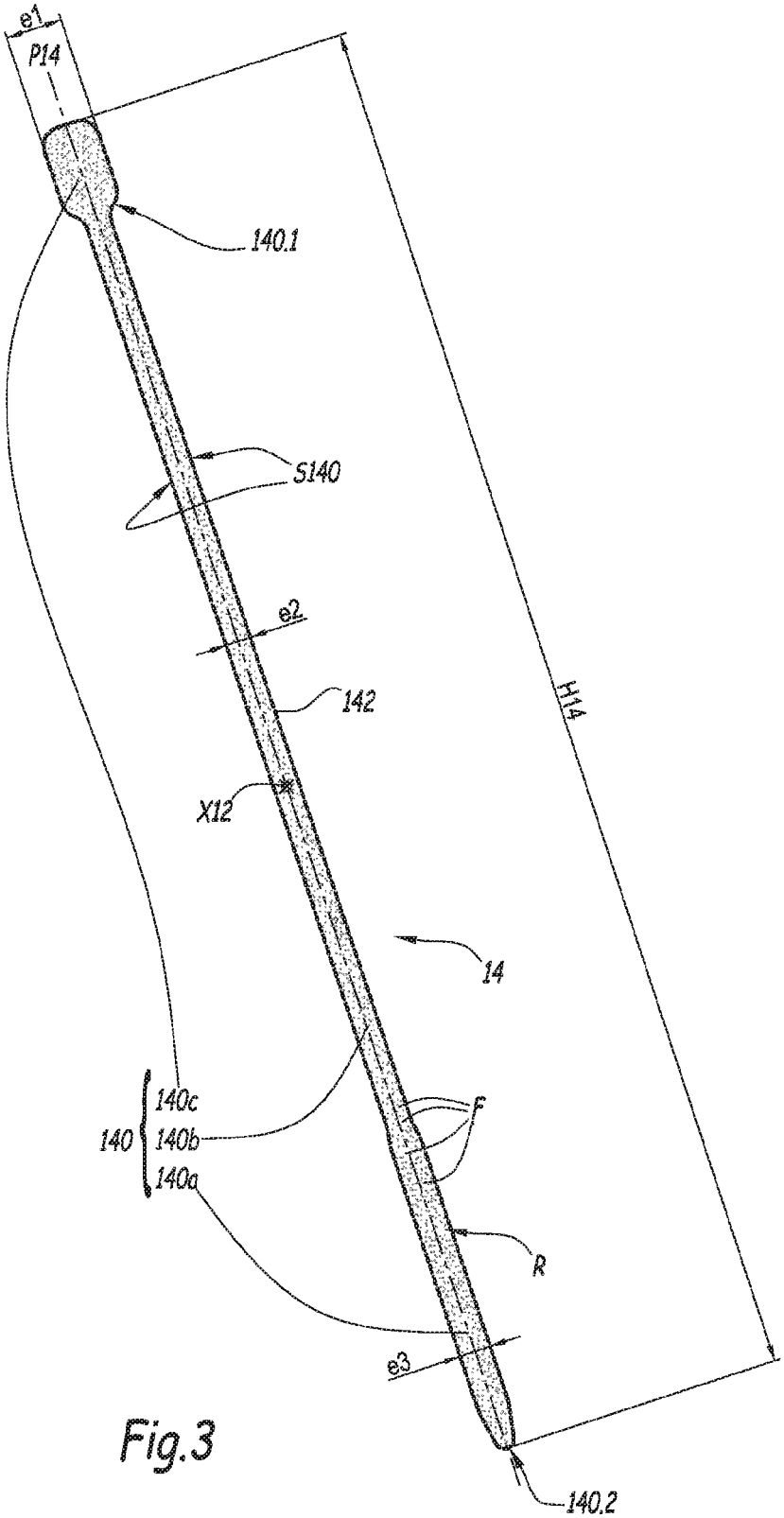
FIG. 3 is a cross section of a profile made from composite material belonging to the blade of FIG. 2.
Figure 4:
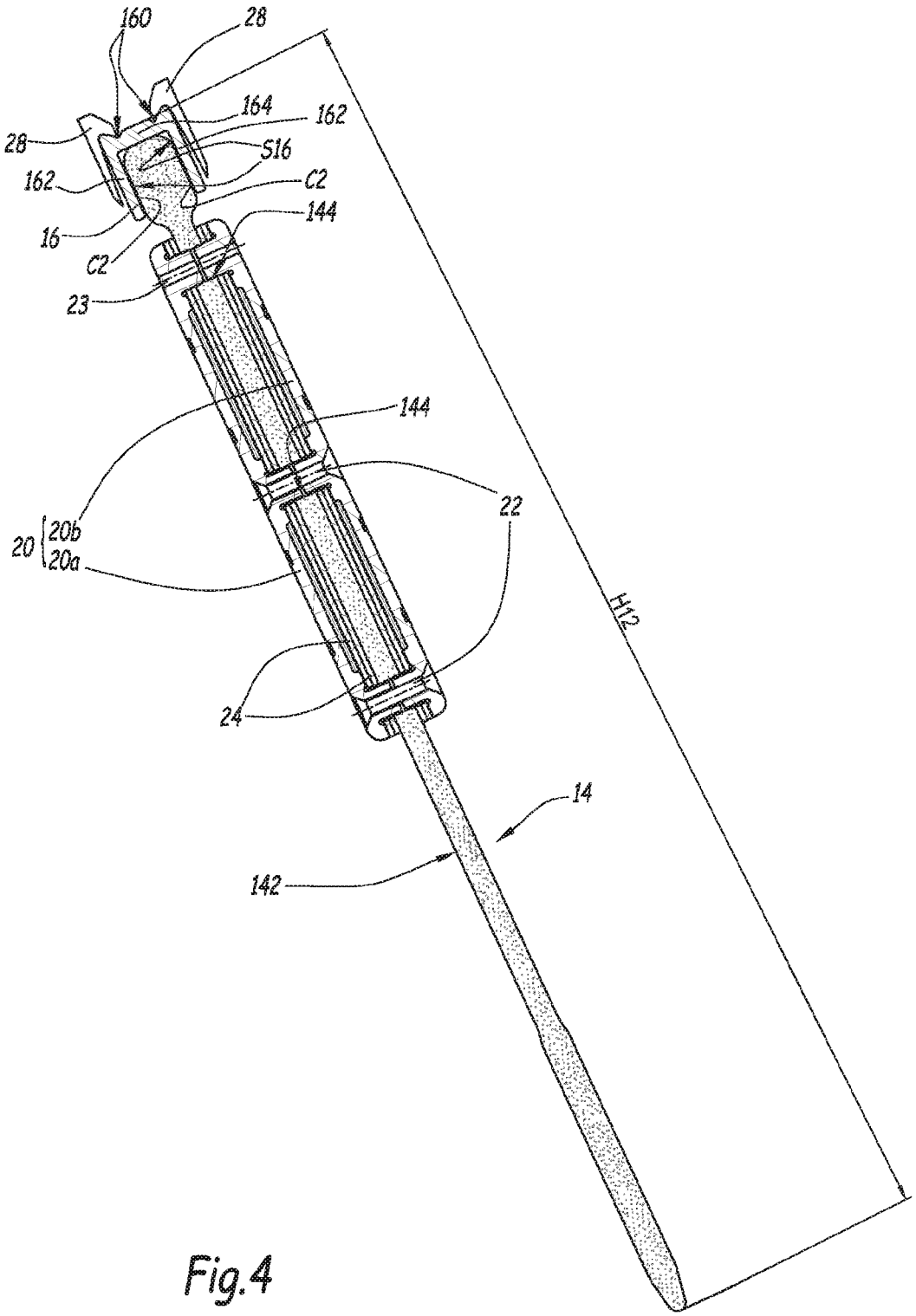
FIG. 4 is an enlarged cross-section, at a pad, of the blade of FIG. 2, in which two hooks are further shown in the configuration cooperating with the blade.

A blade 12 of the Jacquard machine 2 is better visible in FIGS. 2 to 4. In the continuation of the description, a single blade 12 of the Jacquard machine 2 is described, knowing that all of the other blades are identical, even though this is not immediately evident from FIG. 1, since they are arranged head-to-tail.

The longitudinal axis X12 defines the longitudinal direction of the profile 14 and of the blade 12 that is mentioned several times in this document. When the blade 12 is mounted in the Jacquard mechanism, the longitudinal direction corresponds to the direction of the weft yarns on the Jacquard loom. In the example, the blade 12 has a length L12 of 1.8 m, but this length may vary depending on the format of the machine used from 1 m to 4 m. As shown in FIG. 3, the blade 12 comprises a profile 14 made from a composite material having a body 140 made up of unidirectional fibers F that extend in the longitudinal direction of the profile 14 and that are embedded in a resin R. The unidirectional fibers F are said to be long because each fiber F extends substantially over the entire length of the body 140. The profile 14 comprises two longitudinal ends E14 and two side faces S14. In this document, the side direction is a direction perpendicular to the thickness of the blades 12, i.e., perpendicular to the longitudinal direction and to the height of the blades 12. When the blade 12 is mounted in the Jacquard mechanism, the lateral direction corresponds to the direction of the warp yarns on the Jacquard loom. Thus, the side faces S14 of the profile 14 are globally perpendicular to the lateral direction. In FIG. 3, the unidirectional fibers F are shown by dots. In the example, these fibers are carbon fibers, and the resin R is an epoxide resin. In particular, the epoxide resin R that is used includes a hardener. In the present document, the terms "upper" and "lower" must be interpreted in a direction corresponding to the height of the body. In particular, in a configuration where the blades 12 are assembled on the Jacquard mechanism 2, i.e., in the configuration of FIGS. 1 to 5, an "upper" element is positioned above a "lower" element. The body 140 of the profile 14 comprises a lower part 140*a* having an end 140.2 in the form of a curved tip, i.e., having a rounded shape. The body 140 also comprises an upper part 140*c* for driving the hooks 28, i.e., at which the hooks 28 cooperate with the blade, and an intermediate part 140*b* connecting the parts 140*a* and 140*c*. The body 140 has a symmetrical profile relative to a median plane P14 that intersects the body 140 at the middle of its thickness. The body 140 is also symmetrical relative to a transverse plane, not shown, intersecting the body 140 at the middle of its length. The parts 140*a* to 140*c* are solid parts with a globally rectangular section, i.e., not including an inner cavity, recess or other outer notch, that are connected to one another. The intermediate part 140*b* is formed by a single central core, centered on the plane P14, and has a thickness e2 that is smaller than a thickness e1 of the upper part 140*c* and smaller than a thickness e3 of the lower part 140*a*. The thicknesses e1 to e3 are measured perpendicular to the axis X12 and the height H12 of the blade 12. In the example, the thickness e1 is equal to 9 mm, the thickness e2 is equal to 4 mm, the thickness e1 therefore representing 30% to 60% of the thickness e2. In an alternative that is not shown, the intermediate part 140*b* has a variable thickness, the thickness e2 then being the maximum thickness of the intermediate part. The section of the body 140 of the blade 12 has a height H14 of 220 mm. The height H14 is more broadly comprised between 200 mm and 240 mm and is particularly suitable for all formats of Jacquard machines. This height H14 is much greater than the maximum thickness of the body 140, which is, in the example, the thickness e1, which is equal to 9 mm. In practice, the ratio between the height H14 of the body 140 and the maximum thickness of the body 140 is greater than 15, preferably greater than 20. The height of the intermediate part 140*b* represents approximately 150 mm, or 60% to 80% of the height H14. Reference 140.1 denotes the junction portion between the upper part 140*c* for driving the hooks 28 and the intermediate part 140*b*, at which the thickness of the body 140 varies, from the thickness e1 toward the thickness e2.

Similarly, in the continuation of the description, an intermediate part of the profile 14 corresponds to the part of the profile including the part 140*b* of the body 140, an upper part of the profile 14 corresponds to the part of the profile including the part 140*c* of the body 140, and a lower part of the profile 14 corresponds to the part of the profile including the part 140*a* of the body 140.

Unidirectional fibers F are arranged in the upper, intermediate and lower part of the profile 14.

The profile 14 comprises a fiber-based film that covers at least the junction portion 140.1 between the upper part 140*c* and the intermediate part 140*b*, on two side faces S140 of the body. In the example, the film marries the entire outer periphery of the body 140 and forms an outer envelope 142 made from a glass fiber fabric. In other words, the envelope 142 is woven, i.e., it comprises glass fibers 142.1 that intertwine perpendicular to one another. The fibers 142.1 are each globally inclined by approximately 45° relative to the longitudinal direction of the blade 12. In alternative, the outer envelope 142 is a non-woven film with carbon fibers. In FIG. 3, the envelope 142 is shown by broken bold lines. Part of the envelope 142 is diagrammatically shown enlarged in FIG. 2. The envelope 142 protects the fibers and the resin of the body 140 from oils and other outside agents. It also ensures the cohesion of the composite profile 14, which is fragile in a direction transverse to the unidirectional fibers, in particular in the thickness variation zones, and prevents the delamination of the profile 14 when the hooks 28 bear on the blade 12. This in particular has an advantage when the bearing forces of the hooks 28 are not homogenous over the entire length of the blade 12. The profile 14 has a constant section over its length L14.

The blade 12 further comprises two fastening blocks 18 for attaching two connecting rods 8 of the transmission mechanism 6 to the blade 12. These fastening blocks 18 are fastened to the two longitudinal ends E14 of the profile 14, in particular by gluing. A fastening block 18 is better shown in FIG. 5. In the following, only one of the two fastening blocks 18 of a blade 12 is described, the other block being identical.

The fastening block 18 includes an upper end part 18.1, a lower end part 18.3, and a central body 18.2 connecting the parts 18.1 and 18.3. The upper and lower end parts are to be considered in a direction corresponding to the height of the block 18, which corresponds to the direction of the height of the profile 14 when the block 18 is fastened to the profile 14. The central body 18.2 has a U-shaped section, i.e., it includes a bottom wall 180 and two side walls 182 that are parallel to one another. When the fastening block 18 is fastened on the profile 14, the side walls 182 extend parallel to the longitudinal direction of the profile 14 and are oriented toward the latter, while the bottom wall 180 is perpendicular to the longitudinal axis X12 and is across from the longitudinal end surface E14. The side walls 182 therefore define the inner side surfaces S182, which are each turned toward a side face S14 of the profile 14. The gluing of the blocks 18 is done on an outer surface of the profile 14, i.e., on a surface defining the cross-section of the profile over substantially its entire length L14.

Figure 5:
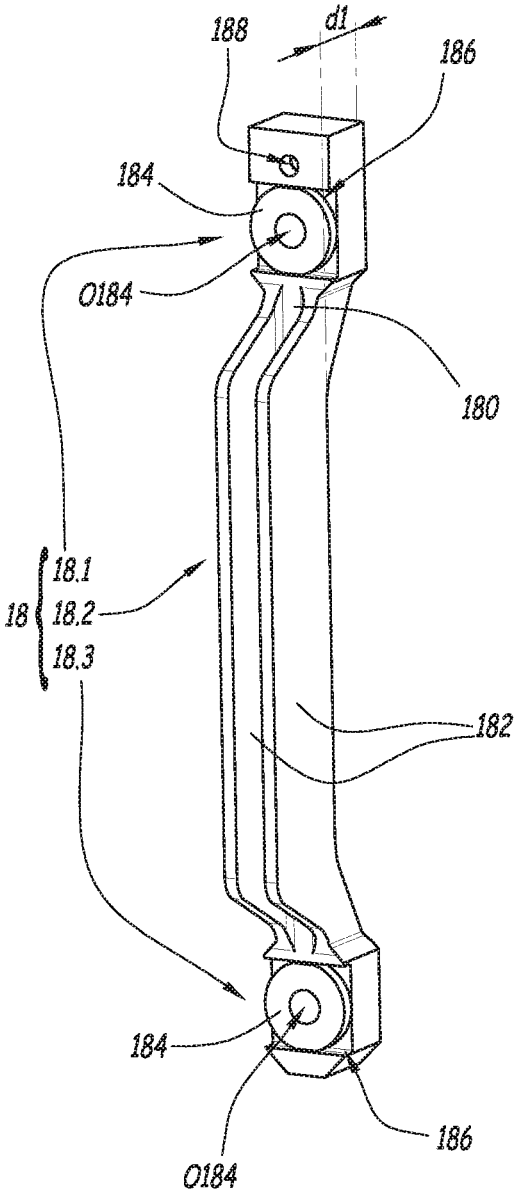
FIG. 5 is a perspective view of a fastening block for a connecting rod of the Jacquard mechanism, the fastening block being intended to be positioned at one end of the blade of FIG. 2.
Figure 6:
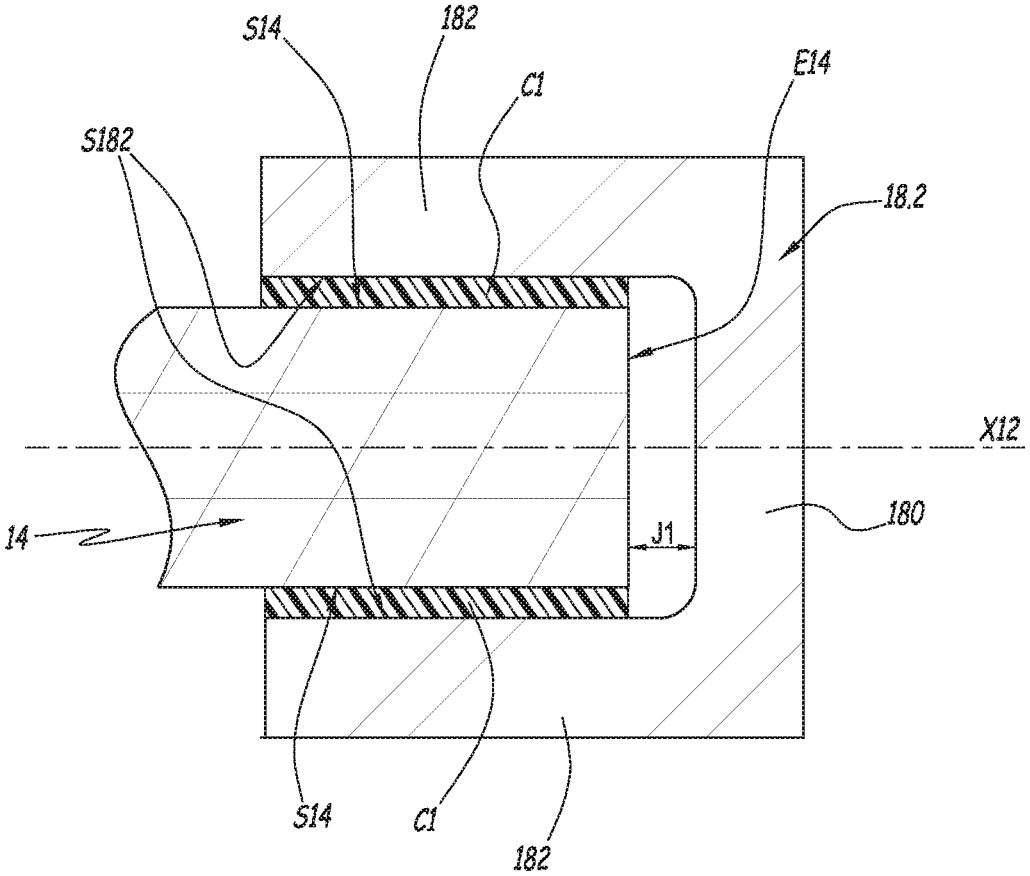
FIG. 6 is a sectional view in plane VI of FIG. 2.

Thus, the fastening of the blocks 18 does not require machining of the profile 14 other than any length L14 adjustment that may be needed, and there is no risk of damaging the distribution of the fibers. The profile 14 therefore has a constant section over its length L14, including at the longitudinal end portions of the profile that are across from the side walls 182. The connecting rod 8 is fastened on the block 18 on the side opposite the profile 14, in the longitudinal direction, i.e., on the side of the outer surface of the bottom wall 180. The body 18.2, and in particular the side walls 182, are longitudinally offset relative to the end parts 18.1 and 18.3, which define the total length L12 of the blade 12. This longitudinal withdrawal is shown in FIG. 5 by the distance d1. This has the advantage that the corresponding connecting rod 8 only bears on the end parts 18.1, 18.3 of the fastening block 18 and not on the bottom wall 180 of the central body 18.2. Furthermore, the longitudinal withdrawal d1 between the body 18.2 and the end parts 18.1 and 18.3 is gradually made up at the junction between the body 18.2 and the end parts 18.1, 18.3. Thus, the transmission of the forces to the glue is done gradually as the Jacquard machine is started up, i.e., when the blade 12 is set in motion by the mechanism 6.

The end parts 18.1 and 18.3 each include a through hole, which is not visible in FIG. 5. This hole emerges, on the side of the profile made from composite material 14, in a recess 186, i.e., in a hollow space arranged in the part 18.1 or 18.3. A tapped insert 184 is inserted inside this hole and defines a tapping O184 for receiving a screw, not shown, for fastening the corresponding connecting rod 8. The insert 184 is tenoned, i.e., it includes a head intended to bear against the bottom of the recess 186. This insert 184 is in practice forcibly mounted inside the hole. The upper end part 18.1 also defines a housing 188 for a centering pin, not shown. This centering pin is provided to extend between the fastening block 18 and the connecting rod 8 and allows precise positioning of the connecting rod 8 relative to the fastening block 18.

The fastening block 18 includes at least one surface intended to be glued against a side face S14 of the profile 14. This makes it possible to size the gluing surface while avoiding adding bulk in the height direction and the longitudinal direction. In the example, the inner surface S182 of each side wall 182 is intended to be glued against a corresponding side face S14 of the profile 14, at the intermediate part of the profile. The two side surfaces S182 extend in the longitudinal direction so as to define an optimal gluing surface, compatible with the forces to be transmitted to the profile 14. Furthermore, this also makes it possible to limit the thickness of the walls 182.

Furthermore, the gluing of the fastening blocks 18 at the intermediate part of the profile 14, near the neutral fiber of the profile 14, i.e., where there are the fewest mechanical stresses in bend, makes it possible to limit the stresses of the glue and to thereby increase the lifetime of the blade 12. Furthermore, since the intermediate part of the profile 14 has a reduced thickness relative to the rest of the profile 14, the lateral bulk created by the fastening of the blocks 18 on the profile 14 is compatible with the space provided for the positioning of the blades 12 in the Jacquard machine 2. In particular, the bulk of the blade 12 according to the invention is substantially equivalent to that of an aluminum blade of the state of the art, which allows them to be interchangeable and guarantees easy assembly of the blade 12 in the Jacquard machine.

Furthermore, using attached intermediate parts, i.e., fastening blocks 18, to attach the blade 12 to the mechanism 6 makes it possible to separate the stiffness function and the connection function to the kinematics of the Jacquard machine 2 and to limit the impact of the connection on the stiffness in bend of the blade 12. In particular, the carbon unidirectional fibers of the profile 14 that are arranged in the upper and lower parts of the profile 14 are preserved, which makes it possible to retain maximum stiffness in bend.

The blade 12 also comprises at least one interface rail 16 with the hooks 28 of the Jacquard mechanism, which is fastened covering the outer surface of the upper end of the profile 14. This makes it possible to separate the stiffness and strength functions in contact with the hooks 28. In the example, the blade 12 comprises several metal interface rails 16, in particular made from aluminum, that are distributed over the length of the profile 14 and that are spaced apart from one another with a longitudinal distance of 12 mm. The use of several rails 16 distributed over the length makes it possible to limit the differential heat expansion between the composite material of the profile 14 and the metal of the interface rails 16, when the operating temperature of the Jacquard machine is above the manufacturing temperature of the blade 12. This thereby makes it possible to avoid geometric deformations of the blade 12 that would not be compatible with the movement of the hooks 28 in the Jacquard machine.

Each rail 16 has a length L16 corresponding to the length L10 of a Jacquard module receiving volume V10 to extend without discontinuity over the length over which the hooks 28 present in a Jacquard module receiving volume cooperate with the blade 12. This length L16 is approximately 380 mm, with an allowance of +/−10 mm. The spacing between two successive rails 16 therefore represents about 2 to 10% of the length L16 of an interface rail 16. The interface rails 16 have a U-shaped section with two branches 162 connected by a bottom wall 164. These interface rails 16 are intended to be fastened on the profile 14, in particular by gluing, around the upper part 140*c* of the body 140. When the rails 16 are mounted on the blade 12, the bottom of each rail 16 is turned downward, i.e., the bottom wall 164 faces the upper end of the profile 14 and the two side walls 162 of the rail 16 extend vertically downward from the bottom wall 164. Thus, each rail 16 comprises two inner side surfaces S16 intended to be glued against the surfaces S14 of the profile 14, at the upper part thereof. The bottom wall 164 of each rail 16 includes, on its outer surface opposite the profile 14, notches 160 for optimized contact with the hooks 28. The side walls 162 extend over the entire height of the hooks 28 when the latter are in contact with the bottom wall 162 and are inserted between the hooks 28 and the profile 14 in the lateral direction to prevent any contact of the hooks 28 with the profile 14. The U-shaped geometry of each rail 16 allows gluing of the rail with the outer surfaces of the profile 14, without machining of the upper part of the profile and while retaining maximum stiffness for the profile.

The height H12 is substantially equal to the sum of the height H14 and the thickness of the bottom wall of the rail 16, to within any play or glue thickness between the upper end of the profile 14 and the bottom wall 164 of the rail 16.

The blade 12 also comprises blade pads 20 that are distributed regularly along the profile 14 with a spacing substantially corresponding to twice the length L10. These pads 20 serve to guide the alternating vertical movement of the blade 12 and cooperate with guides, not shown, fastened on the flanges 10. Each pad 20 is made up of two parts, i.e., it comprises a part 20*a* fastened on a side face S14 of the profile 14 and a part 20*b* fastened on the other side. The parts 20*a* and 20*b* are fastened to one another by screwing. To that end, holes 144 are pierced through the intermediate part of the profile 14 for the passage of screws 22. These screws 22, of which there are two, are screwed through the holes 144 in tappings provided in the part 20*b* of the pad 20. The last hole 144 formed in the profile 14 allows the precise positioning of the pad 20 on the profile 14. Two shims 24 are inserted, on each side, between the side faces S14 of the profile 14 and the parts 20*a* and 20*b* of the pad 20. These shims 24 make it possible to avoid damaging the profile 14 during the fastening of the pad 20.

A method for manufacturing the blade 12 according to the invention is described below.

A first step consists of manufacturing the body 140 of the composite material profile 14. The body 140 may be obtained by pultrusion, i.e., by the passage of preimpregnated fibers in a long heated draw plate that monitors the resin content and determines the shape of the section, or by molding. The resin is polymerized during the pultrusion or the molding operation and hardens. The film 142 is respectively brought directly into the pultrusion die or placed in the mold and adheres to the body 140 by means of the resin R during polymerization.

When it is obtained by pultrusion, the profile 14 is cut to the length corresponding to the format of the Jacquard machine on which it will be mounted. After cutting, the longitudinal end surface E14 of the profile 14 extends substantially in a same plane perpendicular to the longitudinal direction X12. There is no other machining applied to the profile 14, such that the cohesion and stiffness of the profile 14 are preserved.

However, when it is obtained by molding, the profile 14 may be made directly at the length corresponding to the format of the Jacquard machine in question.

Next, the surfaces of the composite profile 14 that are intended to be glued with the rails 16 on the one hand and the fastening blocks 18 on the other hand, are prepared. These surfaces correspond to the side faces of the upper part of the profile 14 and the longitudinal end portions of the side faces of the intermediate part of the profile 14. The preparation of the surfaces consists, advantageously, of slight abrasion, then degreasing before positioning the profile 14 in a tool, not shown. The profile 14 thus prepared is fastened to this tool and the surfaces intended to be glued are glued with an epoxide glue over several tens of millimeters thick. The glue is for example a bi-component epoxide adhesive adapted to materials suitable for gluing, to the dimensions of the surfaces to be glued and to the efforts to be transmitted. Advantageously, the epoxide glue has a tensile strength that is superior to 30 MPa and a breaking elongation that is about 3%.

The interface rails 16 are degreased at the inner surfaces S16 of the two branches intended to be glued against the side faces S14 of the upper part 140*c* of the profile 14. The rails 16 are placed in a longitudinal cap, not shown, and spaced apart from one another in a position similar to that which they must occupy relative to the flanges 10 when they are mounted in the Jacquard mechanism 2. To that end, the cap has positioning tabs that guarantee the alignment of the rails 16 and the spacing between the rails 16. The interface rails 16 are positioned with the free end of the branches oriented downward. The inner side faces S16 of the two branches of the rails 16 are glued with an epoxide glue over several tens of millimeters thick.

The interface rails 16 are next mounted around the upper end of the profile 14, with each inner side surface S16 across from one of the side faces S14 of the upper part of the profile 14 and the glue joints C2 between these side surfaces. The rails 16 are mounted without force, the excess glue is driven toward the bottom of the rails 16, i.e., toward the upper wall of the profile 14. The cap is next fastened to the tool.

The two fastening blocks 18 are each placed on a support, not shown. For example, screws may be used to fasten each fastening block 18 on its support. The tappings defined by the inserts 186 can for example be used to fasten the block 18 on its support. Next, the inner side surfaces S182 of the body 18.2 of the two blocks 18 are degreased, then glued with the epoxide glue. The supports are placed in the tool, which makes it possible to monitor the longitudinal spacing between the two fastening blocks 18 for compliance with the length L12 of the blade and the position of the blocks 18 relative to the profile 14 in the direction of the height. This also makes it possible to ensure the parallelism between the surfaces S14 and the surfaces S182 and between the two fastening blocks 18. During the placement of the blocks 18 in the tool, the bodies 18.2 with a U-shaped section place themselves around the intermediate parts of the two longitudinal ends of the profile 14 previously glued, with each inner side surface S182 across from one of the end portions of the side faces S14 of the intermediate part 140*b* and the glue joints C1 between these side faces. The excess glue is, if necessary, driven toward the bottom 180 of the body 18.2. Indeed, axial play J1 remains between the bottom wall 180 of the body 18.2 of each block 18, the upper end part 18.1, respectively, the lower end part 18.2, respectively, and the corresponding longitudinal end surface E14 of the profile 14. There is therefore no longitudinal contact between the fastening blocks 18 and the profile 14 made from composite material. Furthermore, this axial play J1 makes it possible to have relatively high machining allowances regarding the length of the profile 14. The play J1 represents 0.5 to 1.5 mm. The supports are then fastened to the tool.

The fact that the fastening blocks 18 include a body 18.2 with a U-shaped section placed around the ends E14 of the profile 14 makes it possible to retain access to the glue joints C during the gluing operation, so as to monitor the proper distribution of the glue.

The assembly is kept in the tool during the polymerization time of the glue. Once the fastening blocks 18 and the rails 16 are glued, the profile 14, then equipped with fastening blocks 18 and rails 16, is disassembled from the tool (the supports are separated from the blocks 18) and the pads 20 are screwed on the profile 14. The piercings arranged in the profile 14 for the fastening of the tabs 20 can be made independently before or after the gluing operations.

The blade 12 can be placed in the Jacquard mechanism between two connecting rods 8 connected to the input shaft of the Jacquard mechanism. Two screws each passing through a hole arranged all the way through each connecting rod 8 tighten in the two tappings 184, for the fastening of each corresponding connecting rod 8 against the fastening block 18. Each space between two adjacent rails 16 of the blade 12 is then longitudinally positioned between two adjacent Jacquard module receiving volumes in the longitudinal direction X12. During operation of the Jacquard machine, the mechanism 6, and in particular the connecting rod 8 driven in an alternating vertical translational movement, sets the blade 12 in motion via glue joints C1 between blocks 18 and profile 14.

As one alternative that is not shown, the fastening blocks 18 and the rails 16 can be fastened to the profile 14 other than by gluing, for example by screwing, pinching or clipping. Preferably, the block/profile fastening is done at a side face S14 of the profile 14 and a side wall of the fastening block 18 opposite it. However, the interface rails 16 are preferably fastened by gluing or pinching so as not to alter the distribution of the long fibers in the upper or lower part of the profile 14, i.e., where they have the greatest impact on the stiffness in bend of the blade 12.

According to another alternative that is not shown, the blade 12 does not include fastening blocks 18 and each connecting rod 8 fastens to the profile 14 by pinching the longitudinal end E14 of the profile 14, in particular at the intermediate part of the latter or by screwing in Inserts directly glued to the profile 14.

According to another alternative that is not shown, the body 140 of the profile 14 incorporates unidirectional fibers other than carbon fibers, for example Kevlar fibers or glass fibers.

Advantageously, the hardened epoxide resin R of the profile 14 has a breaking strength in traction superior to 3000 MPa, a tensile strength between 60 MPa and 80 MPa and a braking elongation of about 4%.

According to another alternative that is not shown, the body 140 of the profile 14 is formed by a thermosetting resin R other than an epoxide resin, for example by a polyester resin.

According to another alternative that is not shown, the outer envelope 142 is glued with epoxide glue onto the hardened body 140.

According to another alternative that is not shown, the fastening by gluing of the blocks 18 on the profile 14 is reinforced by screwing elements through the walls 182 and the body 140, i.e., in the transverse direction parallel to the thickness of the profile 14.

According to another alternative that is not shown, the profile 14 is made up of several bodies made from a composite material that are superimposed on one another and that extend in the longitudinal direction. These bodies are connected together with connecting spacers positioned at regular intervals. Each of these bodies is made up of unidirectional fibers that extend in the longitudinal direction of the profile and are embedded in a resin.

According to another alternative that is not shown, applicable to the method for manufacturing the blade by molding, the interface rails 16, the fastening blocks 18 and/or the pads 20 can be directly overmolded during the manufacture of the profile 14. Anchoring geometries with the profile 14 can then be provided on the rails 16, on the blocks 18 and on the pads 20.

According to another alternative that is not shown, the intermediate part 140*b* of the body 140 can be formed from two side flanks spaced apart from one another. The hollow formed by these two lateral flanks can be left empty or filled with a light material, such as foam or basalt. The side flanks of the intermediate part 140*b* then define two inner side surfaces for gluing of the fastening blocks 18. These two inner side surfaces are so-called outer surfaces. Each block 18 then has a single side wall 182 and a glue joint extends between each of the two side surfaces of the side wall 182 and the inner side surface of the opposite profile 14. The profile 14 therefore has a constant section over its length L14, including at the longitudinal end portions of the profile that are across from the side walls 182 of the two blocks 18.

According to another alternative that is not shown, at least one of the fastening blocks 18 comprises one or more guide pads, similar to the pads 20.

According to another alternative that is not shown, at least one of the interface rails 16 comprises one or more guide pads, similar to the pads 20.

According to another alternative that is not shown, the interface rails 16 are attached on the lower part of the composite profile. This configuration corresponds to a particular arrangement of the Jacquard modules relative to the kinematics, in which the lower part of the profile 14 drives the hooks 28.

According to another alternative that is not shown, the envelope 142 is a film woven from polyester, Kevlar, or carbon fibers or a nonwoven film of fibers, which may be glass, polyester, Kevlar, or carbon fibers. In all cases, the envelope 142 differs from the structure used for the body 140, i.e., a structure based on unidirectional fibers in the longitudinal direction embedded in a resin.

According to another alternative that is not shown, the body 18.2 of each fastening block 18 has no bottom wall 180 at the 2 side walls 22.

According to another alternative that is not shown, the composite profile 14 defines, at each of its longitudinal ends, a slot that extends at least at the intermediate part of the profile and emerges on the longitudinal end surface E14 of the profile 14. This slot then defines two side faces that are fastened with a fastening block 18 provided with a single side wall 182 and including connecting means to the kinematic chain, i.e., to the mechanism 6. In particular, a fastening by glue joints between the two side surfaces of the side wall 182 and the two side faces of the slot is favored.

According to another alternative that is not shown, the blades 12 are fastened on one or the other of two gripping frames. Each gripping frame is driven by an alternating vertical oscillating movement, in phase opposition with the other gripping frame, while transmitting this movement to the blades 12 that they bear. The gripping frame is part of the mechanism 6.

According to a second alternative that is not shown, the Jacquard mechanism comprises several input shafts (case of individual motors actuating each oblique bar, or even each blade), a mechanism 6 for transmitting the movement then being inserted between each input shaft and at least one blade 12.

The features of the embodiments and alternatives considered above can be combined to provide new embodiments of the invention.

The invention claimed is:

1. A blade of a Jacquard mechanism, wherein the blade, when mounted in the Jacquard mechanism, is designed for cooperation with and for moving hooks that belong to the Jacquard mechanism, each moving hook being immobilized by a selection device to determine a position of a warp yarn on a loom, the blade comprising a profile made from a composite material having at least one body made of unidirectional fibers that extend in a longitudinal direction of the profile with the fibers being embedded in a resin.

2. The blade according to claim 1, wherein the at least one body of the profile includes an upper part, an intermediate part and a lower part, the intermediate part having a central core with a thickness smaller than a thickness of the lower part and/or smaller than a thickness of the upper part.

3. The blade according to claim 1, wherein the profile includes a fiber-based film that at least partially covers a thickness variation portion of the at least one body.

4. The blade according to claim 1, wherein the unidirectional fibers of the at least one body of the profile are carbon fibers, and in that the resin is an epoxide resin.

5. The blade according to claim 1, wherein a cross-section of the profile is constant over an entire length of the profile.

6. The blade according to claim 1, further comprising two fastening blocks connected to a mechanism for transmitting movement of the Jacquard mechanism, the two fastening blocks being secured to two longitudinal ends of the profile.

7. The blade according to claim 6, wherein each fastening block includes at least one side wall across from a side face of the profile for the securing of each fastening block with the profile.

8. The blade according to claim 6, wherein the two fastening blocks are secured to the profile at least by gluing.

9. The blade according to claim 8, wherein:

the body of the profile includes an upper part, an intermediate part and a lower part, the intermediate part having a central core with a thickness smaller than a thickness of the lower part and/or smaller than a thickness of the upper part, each fastening block includes a body with a U-shaped section, including a bottom wall and two side walls, the two side walls each include an inner surface, the bottom wall is opposite a longitudinal end surface of the profile, and a glue joint extends between each inner surface and a side face of the profile, at the intermediate part of the body.

10. The blade according to claim 7, wherein each fastening block includes upper and lower end parts that are longitudinally offset relative to each side wall and that include fastening means for fastening to the mechanism for transmitting the movement of the Jacquard mechanism.

11. The blade according to claim 1, further comprising at least one longitudinal interface rail that partially covers the outer surface of the profile and cooperates with the moving hooks of the Jacquard mechanism.

12. The blade according to claim 11, comprising several metal interface rails distributed over a length of the profile and spaced apart from one another.

13. The blade according to claim 11, wherein each interface rail has a U-shaped section and is glued around the profile.

14. A Jacquard mechanism, comprising a plurality of moving hooks, a series of blades and a mechanism for moving the blades with an alternating movement in phase opposition, wherein at least one of the blades is according to claim 1.

15. A Jacquard mechanism comprising a blade according to claim 12, and defining several receiving volumes for Jacquard modules including the moving hooks, a spacing between two interface rails on the blade being arranged longitudinally between two adjacent receiving volumes.

* * * * *